US011015232B2

(12) United States Patent
Liu et al.

(10) Patent No.: US 11,015,232 B2
(45) Date of Patent: May 25, 2021

(54) SEAMLESS STEEL TUBE WITH HIGH STRENGTH AND TOUGHNESS AND MANUFACTURING METHOD THEREFOR

(71) Applicant: BAOSHAN IRON & STEEL CO., LTD., Shanghai (CN)

(72) Inventors: Yaoheng Liu, Shanghai (CN); Zhonghua Zhang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 0 days.

(21) Appl. No.: 15/762,660

(22) PCT Filed: Sep. 21, 2016

(86) PCT No.: PCT/CN2016/099561

§ 371 (c)(1),
(2) Date: Mar. 23, 2018

(87) PCT Pub. No.: WO2017/050227

PCT Pub. Date: Mar. 30, 2017

(65) Prior Publication Data

US 2018/0274054 A1 Sep. 27, 2018

(30) Foreign Application Priority Data

Sep. 24, 2015 (CN) ..... 201510615737.9
Apr. 26, 2016 (CN) ..... 201610265674.3
Aug. 30, 2016 (CN) ..... 201610776281.9

(51) Int. Cl.
*C21D 9/08* (2006.01)
*B21B 19/04* (2006.01)
(Continued)

(52) U.S. Cl.
CPC ..... *C21D 9/085* (2013.01); *B21B 19/04* (2013.01); *C21D 1/18* (2013.01); *C21D 1/667* (2013.01);
(Continued)

(58) Field of Classification Search
CPC ..... C22C 38/02; C22C 38/04; C22C 38/06; C22C 38/08; C22C 38/12; C22C 38/40;
(Continued)

(56) References Cited

U.S. PATENT DOCUMENTS 6,217,676 B1 * 4/2001 Takabe ..... C22C 38/06 148/333
2014/0299237 A1 10/2014 Somani et al.
2017/0349963 A1 * 12/2017 Yuga ..... C21D 8/10

FOREIGN PATENT DOCUMENTS

CN 101082112 A 12/2007
CN 101328559 A 12/2008
(Continued)

OTHER PUBLICATIONS

English langauge machine translation of WO-2011108764-A1 to Ishibashi. Generated Jan. 22, 2019. (Year: 2019).*
(Continued)

*Primary Examiner* — Brian D Walck
(74) *Attorney, Agent, or Firm* — Neal, Gerber & Eisenberg LLP

(57) ABSTRACT

A seamless steel tube with high strength and toughness, comprising the following chemical elements by mass: 0.1-0.25% of C, 0.1-0.5% of Si, 0.01-0.1% of Al, 0.6-2% of Mn, the balance of Fe and other unavoidable impurities, wherein C+Mn/6≥0.35. Also provided is a method for preparing a seamless steel tube.

11 Claims, 1 Drawing Sheet

(51) Int. Cl.

| | |
|---|---|
| ***C21D 1/18*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/40*** | (2006.01) |
| ***C21D 11/00*** | (2006.01) |
| ***C21D 1/667*** | (2006.01) |
| ***C21D 6/00*** | (2006.01) |
| ***C22C 38/00*** | (2006.01) |
| *C21D 8/10* | (2006.01) |

(52) U.S. Cl.

CPC ..... *C21D 6/005* (2013.01); *C21D 6/008* (2013.01); *C21D 9/08* (2013.01); *C21D 11/005* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/40* (2013.01); *C21D 8/10* (2013.01); *C21D 8/105* (2013.01); *C21D 2211/002* (2013.01); *C21D 2211/003* (2013.01); *C21D 2211/005* (2013.01); *C21D 2211/008* (2013.01); *C21D 2211/009* (2013.01)

(58) Field of Classification Search

CPC ..... B21B 19/04; C21D 1/18; C21D 1/667; C21D 6/005; C21D 6/008; C21D 9/085

USPC ..... 148/320

See application file for complete search history.

(56) References Cited

FOREIGN PATENT DOCUMENTS

| | | | | | |
|---|---|---|---|---|---|
| EP | 0505732 | B1 | | 8/1995 | |
| JP | 58019438 | A | * | 2/1983 | ..... C21D 9/08 |
| JP | S5819438 | A | | 2/1983 | |
| JP | S6067623 | A | | 4/1985 | |
| WO | WO-2011108764 | A1 | * | 9/2011 | ..... B21C 23/002 |

OTHER PUBLICATIONS

"Hardness Conversion Chart." Carbide Depot. http://www.carbidedepot.com/formulas-hardness.htm. Accessed May 13, 2019. (Year: 2019).*

Penha et al. "Tempering of Steels" ASM Handbook, vol. 4A, Steel Heat Treating Fundamentals and Processes. pp. 327-351. 2013. (Year: 2013).*

* cited by examiner

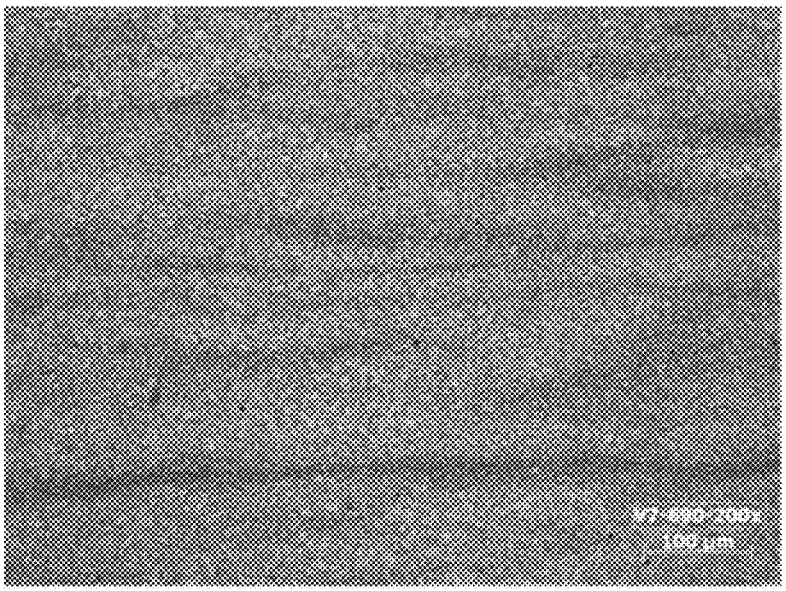
X7,000 200x
100 μm

SEAMLESS STEEL TUBE WITH HIGH STRENGTH AND TOUGHNESS AND MANUFACTURING METHOD THEREFOR

CROSS-REFERENCE TO RELATED APPLICATION

This application is a national stage entry pursuant to 35 U.S.C. § 371 of International Application No. PCT/CN2016/099561, filed on Sep. 21, 2016, which claims priority to Chinese Patent Application No. 201510615737.9, filed on Sep. 24, 2015, Chinese Application No. 201610265674.3, filed on Apr. 26, 2016, and Chinese Patent Application No. 201610776281.9, filed Aug. 30, 2016, the contents of all of which are fully incorporated herein by reference.

TECHNICAL FIELD

The invention relates to a tube and manufacturing method therefor, and particularly to a steel tube and manufacturing method therefor.

BACKGROUND

Restricted by product form and manufacturing method of the seamless steel tube, for a long time, the performance of the seamless steel tube can be improved only by adding alloying elements and controlling the process of post-rolling off-line heat treatment. Taking oil well tube as an example, it is required to add more alloying elements or carry out off-line quenching and tempering treatment so as to obtain the seamless steel tube corresponding to level of 555 MPa (80 ksi) or above. However, it obviously increases the cost of manufacturing the seamless steel tube.

As the conventional process for hot-rolling steel tube, the tube after rolling is put into a pipe storehouse first and then subjected to heat treatment as needed, which brings not only a waste of residual heat after rolling (the temperature of the steel tube after rolling is usually above 900° C.), but also a complexity of process and an increased cost. Furthermore, the tubes cannot be strengthened by off-line heat treatment using the induced phase transition effect after material deformation. According to the research, when the steel after the deformation is immediately on-line quenched, its performance is significantly higher than that of tube that is reheated and quenched after cooling.

As described above, although the skilled in the art has known that on-line quenching helps to make the seamless steel tube a better performance, the on-line quenching is still not used in the prior art. This is because the seamless steel tube, different from steel plates, has its special section shape and has more complicated internal stress state than that of the plate. If the on-line quenching process is adopted, it is difficult to control the performance steadily, and on the other hand the steel tube is likely to crack.

DISCLOSURE OF INVENTION

The purpose of the invention is to provide a seamless steel tube with high strength and toughness. Such seamless steel tube has good balance between high strength and good toughness. Moreover, no expensive alloying element is added in the seamless steel tube of the present invention, and the cost of alloy addition is economical.

To achieve the above purpose, the invention provides a seamless steel tube with high strength and toughness, comprising following chemical elements by mass:

C: 0.1-0.25%,

Si: 0.1-0.5%,

Al: 0.01-0.1%.

Mn: 0.6-2%, and the balance being Fe and other unavoidable impurities; wherein the amounts of C and Mn satisfy: $C+Mn/6 \geq 0.35$.

The designing principle of each chemical element in the seamless steel tube with high strength and toughness in the invention is described as follows.

Carbon: 0.1-0.25%

Carbon is an important element to ensure the strength and hardenability of the steel tube. When the content of carbon is less than 0.1%, it is difficult to guarantee the strength of steel, furthermore, it is difficult to avoid the precipitation of pro-eutectoid ferrite, which affects the sulfur resistance of steel. When being on-line quenched, the steel is influenced by both deformation stress and structural stress, thus the material is more likely to crack compared with off-line quenching. Based on the technical solution of the invention, the formation of the quenching cracks of the seamless steel tube can be obviously reduced by controlling the content of carbon in the range of 0.1-0.25%.

Si: 0.1-0.5%

Silicon is an element that is brought into the steel by a deoxidizer. Once its content exceeds 0.5%, the tendency for cold-brittleness of the steel will increase significantly. For this reason, it is necessary to limit the content of silicon to 0.5% or less. On the other hand, the content of silicon in the steel should be 0.1% or above so as to ensure the deoxidization effect of the steel.

Al: 0.01-0.1%

Similarly, aluminum is another element brought into the steel by deoxidizer. Aluminum with small amount does favor on refining the grain of steel. However, if the content of aluminum is too high that it will bring adverse effects on billet casting and hot processing, etc. In view of this, the aluminum content in the seamless steel tube with high strength and toughness of this invention is set to 0.01-0.1%.

Mn: 0.6-2.0%

Manganese is also brought into the steel by deoxidizer. Manganese does favor on enlarging the austenite phase, increasing the hardenability of steel and refining the grain. But manganese is likely to segregate during solidification, resulting in obvious banded structures in the seamless steel tube. The banded structure is obviously different from the matrix of the seamless steel tube in hardness and the precipitated phase, and such difference will affect the toughness of the steel. Therefore, the content of manganese in the seamless steel tube with high strength and toughness of this invention should be controlled no more than 2%. At the same time, in order to ensure the hardenability of steel, the content of manganese in the steel should be 0.6% or above.

$C+Mn/6 \geq 0.35$

The strengthening effect of the seamless steel tube in the present invention is achieved through a combination of solid solution strengthening, precipitation strengthening, etc. Without adding additional alloying elements, a certain amount of C and Mn elements should be ensured so as to obtain enough strengthening effect. When the amounts of C and Mn satisfy the above relation, the strengthening effect of the steel can be effectively ensured, thereby ensuring the high toughness of steel.

Further, the microstructure of the seamless steel tube with high strength and toughness according to the present invention is mainly in form of martensite, and the ratio of martensite phase is not less than 75%.

Further, the microstructure of the seamless steel tube with high strength and toughness according to the present invention further comprises a small amount of ferrite and bainite.

Further, the seamless steel tube with high strength and toughness according to the present invention comprises other unavoidable impurities by mass as follows: S≤0.005%, P≤0.02%, and O≤0.01%.

Unavoidable impurities in the seamless steel tube with high strength and toughness according to the present invention are mainly elements S, P and O. Among them, elements P and S are the harmful elements in the steel, wherein element S has negative impacts on the hot workability and toughness of the steel and so on, while element P has negative impacts on the hot workability and toughness of the steel. In view of this, the amount of S needs to be controlled ≤0.005%, and the amount of P is controlled ≤0.02%. Element O is an element that reduces toughness, and its content needs to be controlled no more than 0.01%. Preferably, the content of the element O is controlled no more than 0.005%.

Further, the seamless steel tube with high strength and toughness according to the present invention has a yield strength ≥555 MPa. and an impact energy (full-size test piece) at 0° C.>50 J.

Another purpose of the invention is to provide a method for producing a seamless steel tube with high strength and toughness. A seamless steel tube with high strength and good toughness can be obtained by this method. The manufacturing method for the seamless steel tube with strength and toughness can make full use of the residual heat after rolling, thereby effectively reduces the waste of energy consumption, and further reduces the cost of process manufacturing. Besides, the manufacturing method can also effectively avoid cracks of the seamless steel tube.

In order to achieve the above object of the invention, this invention provides a method for producing the seamless steel tube with high strength and toughness, comprising steps of:

(1) smelting and forming a billet:

(2) heating the Billet, followed by piercing, rolling, stretch reducing or sizing, so as to obtain tube, wherein the cross-sectional area ratio of Billet to tube is more than 4.5 (It should be noted that, although the cross-sectional area ratio between the billet and the tube is defined to a lower limit of 4.5 and no upper limit is defined, the cross-sectional area ratio of the billet to the tube could not be 10 or more according to actual equipment situation, that is to say, there will be an upper limit by the production capacity of the equipment);

(3) online quenching: the quenching starting temperature is 850-1100° C., the cooling rate is 20-60° C./s, the Rockwell hardness of the steel tube after quenching is more than 40HRC;

(4) tempering: the tempering temperature is 500-700° C.

The core of the manufacturing method of the seamless steel tube with high strength and toughness according to the present invention lies in the online quenching step. As described above, an online quenching is to quench the steel tube immediately after hot rolling. The quenching in the prior art is generally off-line quenching, namely, the steel tube first enters the pipe storehouse after rolling, and then heat treatment is carried out according to the subsequent production needs. As such, a waste of residual heat after rolling occurs (the temperature of steel tube after rolling is usually above 900° C.), and on the other hand heat treatment additionally requires a lot of heart energy so that the heat energy consumption for manufacturing the seamless steel tube increases significantly. The comprehensive mechanical property of steel subjected to the rapid cooling and quenching immediately after the hot-rolled steel tube's deformation is obviously higher than that of the steel subjected to the process of reheating and quenching after being cooled. However, the seamless steel tube using online quenching is very likely to crack, so this technical solution of the invention strictly controls the specific process parameters of online quenching, so that compared with the prior art, the manufacturing method of the invention not only makes full use of the residual heat after rolling, but also obtains the strengthening effect of the steel tube through the effect of deformation inducing phase transition of the steel tube, so as to prevent the seamless steel tube from cracking, and improve the strength of the steel, enhance the toughness of the steel without adding additional expensive alloying elements.

In the online quenching step, part of pro-eutectoid ferrite will form in the steel tube if the quenching starting temperature is lower than 850° C., the required microstructure (for example, martensite structure) after quenching cannot be guaranteed, so it is necessary to ensure that the temperature of the steel tube is no less than 850° C. At the same time, the cooling rate is controlled in the range of 20-60° C./s. When the cooling rate is relatively slow, it is difficult to obtain the required microstructure (for example, martensite), whereas when the cooling rate is relatively fast, the steel tube tend to crack due to a large internal stress caused by the deformation of the steel tube.

In addition, in the tempering step, when the tempering temperature is <500° C., the internal stress of the steel tube cannot be effectively reduced, and enough toughness of the steel tube cannot be ensured. When the tempering temperature is >700° C., the microstructure of the steel tube such as martensite disintegrates, and the dislocation density decreases rapidly, the high strength required for the steel tube cannot be ensured. Therefore, the tempering temperature is controlled 500-700° C.

Further, in the manufacturing method of the steel tube with high strength and toughness according to the present invention, wherein in step (2), the billet is heated to 1100-1250° C. and maintained for 1-4 hours.

Further, in the manufacturing method of the steel tube with high strength and toughness according to the present invention, wherein in step (2), the ratio of the cross-sectional area of the billet before said stretch reducing or sizing to the cross-sectional area of the billet after said stretch reducing or sizing is more than 1.05. (It should be noted that, although only the lower limit of the ratio is defined as 1.05 while no upper limit is defined, there will be an upper limit of generally about 1.3 according to the actual equipment situation, that is to say, the upper limit will be defined by the production capacity of the equipment).

Further, in the manufacturing method of the steel tube with high strength and toughness according to the present invention, wherein in step (3), quenching is implemented by evenly spraying water around the tube or immersing the steel tube in water.

The technical solution of the invention has made full use of the residual heat after rolling, obtains the strengthening effect of the steel tube through the effect of deformation inducing phase transition of the steel tube. Without adding expensive alloying elements, the heat energy consumption of the production process is saved, and the comprehensive mechanical property of the steel tube is improved, meanwhile cracks of the steel tube being avoided effectively.

For the technical solution, the strengthening effect of the steel tube is achieved by deformation inducing phase transition of the steel tube, so the strength of the seamless steel tube according to the invention is high, and the yield strength thereof is ≥555 MPa.

Furthermore, the seamless steel tube according to the invention has a high toughness, and has an impact energy (full-size test piece) at 0° C. of >50 J Furthermore, the seamless steel tube is suitable for oil-gas exploitation or a tube for mechanical structure.

The seamless steel tube with high strength and good toughness can be obtained by the manufacturing method of the seamless steel tube with high strength and toughness according to the invention through controlling the heat deformation, the quenching temperature, the cooling speed and the tempering temperature.

Furthermore, the manufacturing method of the seamless steel tube with high strength and toughness according to the invention is simple in process, low in energy consumption, and low in cost and high in efficiency.

BRIEF DESCRIPTION OF DRAWINGS

FIG. 1 is a microstructure diagram of the seamless steel tube with high strength and toughness according to Example A7 of the invention.

DETAILED DESCRIPTION

The seamless steel tube with high strength and toughness and the manufacturing method thereof are now explained and described accompanying drawings and the specific embodiments as follows, and the explanation and the description shall not be deemed to limit the technical scheme of the invention.

Example A1-A8 and Comparative Example B1-B5

Seamless steel tubes in Example A1-A8 and Comparative Example B1-B5 were manufactured according to the following steps:

(1) smelting and forming billet: molten steel was smelted, wherein the mass percentage of each chemical element was controlled as shown in Table 1. The smelted molten steel was directly cast into a round billet, or cast into blank followed by forging (or rolling) into a billet;

(2) heating the billet, followed by piercing, rolling, stretch reducing or sizing, so as to obtain tube: the billet was heated to 1100-1250° C. and maintained for 1-4 hours according to the size of the billet. In order to guarantee the strengthening effect, the cross-sectional area ratio of the billet to the tube was more than 4.5, the ratio of the cross-sectional area of the billet before stretch reducing or sizing to the cross-sectional area of the billet after stretch reducing or sizing is more than 1.05;

(3) online quenching: quenching was implemented by evenly spraying water around the tube or immersing the steel tube in water, wherein the quenching starting temperature is ≥850° C., the cooling rate was 20-60° C./s, and the Rockwell hardness of the steel tube after quenching was more than 40HRC.

(4) tempering: the tempering temperature was 500-700° C. and maintained for 1 hr.

The specific processing parameters of the manufacturing method of the seamless steel tube in the examples and the comparative examples are shown in Table 2, wherein the Rockwell hardness of the steel tube after online quenching was measured by a Rockwell hardness tester.

It should be noted that the key point of the manufacturing method of the seamless steel tube with high strength and toughness described above is steps (2) to (4), which does not imply that the manufacturing method of the seamless steel tube with high strength and toughness in the actual production process includes only the above steps, and other steps of the prior art in this field can be used and are not specifically limited in this technical solution.

Table 1 lists the mass percentages of chemical elements in the seamless steel tubes of Example A1-A8 and Comparative Example B1-B5.

TABLE 1

(by wt %, the balance is Fe and other unavoidable impurities except S, P and O)

| No. | C | Si | Al | Mn | S | P | O | C + Mn/6 | Remarks |
|---|---|---|---|---|---|---|---|---|---|
| A1 | 0.12 | 0.27 | 0.02 | 1.82 | 0.003 | 0.018 | 0.005 | 0.423 | — |
| A2 | 0.18 | 0.18 | 0.015 | 1.05 | 0.003 | 0.015 | 0.004 | 0.355 | — |
| A3 | 0.16 | 0.35 | 0.03 | 1.32 | 0.001 | 0.017 | 0.008 | 0.380 | — |
| A4 | 0.24 | 0.38 | 0.02 | 0.78 | 0.002 | 0.012 | 0.003 | 0.370 | — |
| A5 | 0.11 | 0.25 | 0.05 | 1.73 | 0.002 | 0.018 | 0.004 | 0.398 | — |
| A6 | 0.22 | 0.44 | 0.03 | 0.95 | 0.004 | 0.016 | 0.005 | 0.378 | — |
| A7 | 0.20 | 0.42 | 0.07 | 1.21 | 0.002 | 0.012 | 0.003 | 0.402 | — |
| A8 | 0.18 | 0.48 | 0.04 | 1.17 | 0.002 | 0.010 | 0.002 | 0.375 | — |
| B1 | 0.16 | 0.35 | 0.025 | 1.33 | 0.009 | 0.025 | 0.008 | 0.382 | S and P over range |
| B2 | 0.22 | 0.44 | 0.08 | 0.45 | 0.004 | 0.015 | 0.005 | 0.295 | Mn over range and C + Mn/6 over range |
| B3 | 0.18 | 0.58 | 0.03 | 1.17 | 0.002 | 0.01 | 0.002 | 0.375 | Si over range |
| B4 | 0.18 | 0.58 | 0.04 | 1.17 | 0.002 | 0.01 | 0.002 | 0.375 | Si over range |
| B5 | 0.18 | 0.58 | 0.02 | 1.17 | 0.002 | 0.01 | 0.002 | 0.375 | Si over range |

Table 2 lists the specific process parameters of the manufacturing methods of the seamless steel tubes of the Example A1-A8 and Comparative Example B1-B5

TABLE 2

| | Step (2) | | | | Step (3) | | | |
|---|---|---|---|---|---|---|---|---|
| No. | Heating temperature of billet (° C.) | Storage time (hr) | Cross-sectional area ratio of billet to tube | Ratio of the cross-sectional area of billet before stretch reducing or sizing to that of billet after stretch reducing or sizing | Quenching temperature (° C.) | Cooling temperature (° C./s) | Rockwell hardness of the steel tube (HRC) | Step (4) Tempering temperature (° C.) |
| A1 | 1180 | 2 | 8.4 | 1.15 | 860 | 35 | 45 | 580 |
| A2 | 1200 | 2.5 | 7.8 | 1.22 | 890 | 32 | 50 | 560 |
| A3 | 1240 | 1.5 | 7.6 | 1.18 | 880 | 33 | 50 | 500 |
| A4 | 1200 | 2.5 | 6.4 | 1.09 | 930 | 28 | 52 | 640 |
| A5 | 1170 | 2 | 6.8 | 1.08 | 920 | 30 | 44 | 620 |
| A6 | 1200 | 2 | 7.2 | 1.11 | 910 | 39 | 49 | 670 |
| A7 | 1220 | 2.5 | 5.1 | 1.10 | 960 | 27 | 51 | 600 |
| A8 | 1120 | 3 | 5.5 | 1.12 | 950 | 28 | 50 | 600 |
| B1 | 1200 | 3 | 6.4 | 1.09 | 920 | 34 | 49 | 610 |
| B2 | 1200 | 2.5 | 6.7 | 1.12 | 910 | 36 | 53 | 500 |
| B3 | 1180 | 2.5 | 4.2 | 1.03 | 970 | 28 | 51 | 500 |
| B4 | 1240 | 2.5 | 7.2 | 1.08 | 800 | 30 | 38 | 500 |
| B5 | 1200 | 2 | 5.1 | 1.11 | 890 | 14 | 37 | 500 |

After sampling the seamless steel tubes from Example A1-A8 and Comparative Example B1-B5, the mechanical properties of these samples were tested, and the results are shown in Table 3, wherein the yield strength is an average value obtained according to the API standard test after the seamless steel tube is processed into the API arc-shaped sample. The impact energy was tested by the standard impact sample of the seamless steel tube processed into 10*10*55 size and V-notch at 0° C.

Table 3 lists the relevant performance parameters of the seamless steel tubes of Example A1-A8 and Comparative Example B1-B5.

TABLE 3

| No. | Yield strength $Rp_{0.2}$ (MPa) | Impact energy (full-size test piece, 0° C.) (J) |
|---|---|---|
| A1 | 590 | 118 |
| A2 | 645 | 97 |
| A3 | 790 | 89 |
| A4 | 610 | 123 |
| A5 | 708 | 130 |
| A6 | 596 | 105 |
| A7 | 698 | 121 |
| A8 | 714 | 107 |
| B1 | 705 | 35 |
| B2 | 520 | 72 |
| B3 | 496 | 68 |
| B4 | 472 | 154 |
| B5 | 422 | 165 |

As can be seen from Table 1 and Table 3, since the mass percentages of chemical elements and the process parameters in the seamless steel tubes of Example A1 to A8 are all within the ranges defined by the technical solution of the invention, the yield strength of the seamless steel tube of Example A1 to A8 is ≥590 MPa and the impact energy is ≥89 J. On the other side, since contents of P and S elements in the seamless steel tube of Comparative Example B1 were so high, that the impact energy of the seamless steel tube of Comparative Example B1 is only 35 J, the toughness of the seamless steel tube is significantly decreased. In addition, the content of Mn and the value of C+Mn/6 in the seamless steel tube of Comparative Example B2 were so low, that the hardenability of the seamless steel tube of Comparative Example B2 was affected and the yield strength of the seamless steel tube of Comparative Example B2 is only 520 MPa, indicating that the strength of the seamless steel tube is not high, and unable to meet the strength requirement of the seamless steel tube with high strength and toughness of the invention.

As can be seen from Table 2 and Table 3, content of Mn in the seamless steel tubes of all Comparative Example B3-B5 exceed the range defined by the technical solution of the invention. In addition, since the ratio of the cross-sectional area of the billet to the cross-sectional area of the tube and the ratio of the cross-sectional area of the billet before stretch reducing or sizing to the cross-sectional area of the billet after stretch reducing or sizing of the seamless steel tubes in comparative example B3 in step (2) exceed the range defined by the technical solution of the invention, the strengthening effect of the deformation inducing phase transition is affected, resulting in insufficient strength of the steel tube, and the yield strength of Comparative Example B3 is only 496 MPa. In addition, since the quenching temperature of the seamless steel tube of the comparative example B4 is too low, it results that pro-eutectoid ferrite is first produced in the microstructure in the steel tube, thereby decreasing the strength of the steel tube, and its yield strength is only 472 MPa. In addition, since the cooling rate of the seamless steel tube of the comparative example B5 was too slow, the ratio of the martensite phase in the microstructure of the steel tube is insufficient, the seamless steel tube cannot obtain sufficient strength, as a result, the yield strength of the seamless steel tube of Comparative Example B5 is only 422 MPa.

As can be seen from Table 1, Table 2 and Table 3, the yield strength of the seamless steel tubes for all Example A1-A8 is ≥590 MPa and the impact energy thereof is ≥89 J, indicating that the seamless steel tubes of Example A1-A8 have both higher yield strength and better toughness.

The microstructure of the seamless steel tube with high strength and toughness of Example A7 is shown in FIG. 1.

As can be seen from FIG. 1, the microstructure of the seamless steel tube with high strength toughness is composed of martensite mainly, and a small amount of ferrite and bainite.

In the present invention, the cost of alloy addition of the seamless steel tube with high strength and toughness is low, the manufacturing process is energy-saving. Thus the production method of the seamless steel tube with high strength and toughness is economical, has wide applications and can be promoted to a steel tube production line having strict control requirements on production cost.

The seamless steel tube with high strength and toughness can be used for oil gas exploitation or a tube for mechanical structure.

It should be noted that the above examples are only specific embodiments of the invention. Apparently, the invention is not limited to the above embodiments, and there may be many similar variations. A person skilled in the art can directly derive or associate all the variations from the content disclosed by the invention, all of which shall be covered by the protection scope of the invention.

The invention claimed is:

1. A seamless steel tube consisting of chemical elements by mass: C, 0.1-0.25%; Si, 0.1-0.5%; Al, 0.01-0.1%; Mn, 0.6-2%; and the balance being Fe and other unavoidable impurities, wherein the amounts of C and Mn satisfy: $C+Mn/6 \geq 0.35$, wherein the microstructure of steel comprises a tempered martensite phase of not less than 75%; wherein the other unavoidable impurities comprise $S \leq 0.005\%$, $P \leq 0.02\%$, and $O \leq 0.01\%$ by mass, and wherein the seamless steel tube is obtained from a seamless steel tube that has a Rockwell hardness of more than 40HRC after quenching and rolling, and before tempering.

2. The seamless steel tube according to claim 1, wherein the microstructure of steel further comprises ferrite and bainite.

3. The seamless steel tube according to claim 1, wherein the seamless steel tube further has a yield strength ≥555 Mpa, and an impact energy (full-size test piece) at 0° C.>50 J.

4. A method for producing the seamless steel tube according to claim 1, comprising steps of:

(1) smelting and forming a billet;

(2) heating the billet, followed by piercing, rolling, stretch reducing or sizing, so as to obtain tube, wherein the cross-sectional area ratio of billet to tube is more than 4.5;

(3) online quenching, wherein the quenching starting temperature is 850-1100° C., the cooling rate is 20-60° C./s, the Rockwell hardness of the steel tube after quenching is more than 40HRC; and (4) tempering: the tempering temperature is 500-700° C.

5. The method according to claim 4, wherein in step (2), the billet is heated to 1100-1250° C. and maintained for 1-4 hours.

6. The method according to claim 4, wherein in step (2), the ratio of the cross-sectional area of the billet before said stretch reducing or sizing to the cross-sectional area of the billet after said stretch reducing or sizing is more than 1.05.

7. The method according to claim 4, wherein in step (3), said quenching implemented by evenly spraying water around the tube or immersing the steel tube in water.

8. A seamless steel tube consisting of chemical elements by mass: C, 0.1-0.25%; Si, 0.1-0.5%; Al, 0.01-0.1%; Mn, 0.6-2%; and the balance being Fe and other unavoidable impurities, wherein the amounts of C and Mn satisfy: $C+Mn/6 \geq 0.35$, wherein the microstructure of steel comprises a tempered martensite phase of not less than 75%, obtained by a method comprising:

(1) smelting and forming a billet;

(2) heating the billet, followed by piercing, rolling, stretch reducing or sizing, so as to obtain tube, wherein the cross-sectional area ratio of billet to tube is more than 4.5;

(3) online quenching, wherein the quenching starting temperature is 850-1100° C., the cooling rate is 20-60° C./s, the Rockwell hardness of the steel tube after quenching is more than 40HRC; and (4) tempering: the tempering temperature is 500-700° C.

9. The seamless steel tube according to claim 8, wherein the microstructure of steel further comprises ferrite and bainite.

10. The seamless steel tube according to claim 8, wherein the other unavoidable impurities comprise $S \leq 0.005\%$, $P \leq 0.02\%$, and $O \leq 0.01\%$ by mass.

11. The seamless steel tube according to claim 8, wherein the seamless steel tube further has a yield strength ≥555 Mpa, and an impact energy (full-size test piece) at 0° C.>50 J.

* * * * *